United States Patent [19]

Van Boven et al.

[11] 4,085,726

[45] Apr. 25, 1978

[54] FORCED AIR FURNACE MOTOR LEAD WIRE PROTECTION

[75] Inventors: Donald G. Van Boven, Elyria; John C. Burdett, Lima; Richard J. Vales, Elyria, all of Ohio

[73] Assignee: Westinghouse Electric Corporation, Pittsburgh, Pa.

[21] Appl. No.: 752,720

[22] Filed: Dec. 20, 1976

[51] Int. Cl.[2] ..... F24F 3/06

[52] U.S. Cl. ..... 126/110 R; 174/68 C

[58] Field of Search ..... 126/110 R, 116 R, 110 A; 174/68 C, 16 R, 101

[56] References Cited

U.S. PATENT DOCUMENTS

| | | | |
|---|---|---|---|
| 1,094,109 | 4/1914 | Alpaugh | 174/68 C |
| 1,189,208 | 6/1916 | Hodkinson | 174/68 C |
| 3,881,520 | 5/1975 | Murphy | 174/68 C |
| 3,956,674 | 5/1976 | Farley | 126/110 R X |

*Primary Examiner*—Edward G. Favors
*Attorney, Agent, or Firm*—E. C. Arenz

[57] ABSTRACT

The invention provides an arrangement for shielding non-metallic motor leads from damage during servicing within the cabinet of a forced air furnace having a double inlet centrifugal blower housing containing a fan wheel and a direct drive motor which is resiliently mounted to the blower housing. The arrangement includes a channel-shaped raceway and a junction box which are aligned on the blower housing support plate in an arrangement permitting the raceway to be secured to both the junction box and the side of the blower housing in a way which does not interfere with the resilient mounting of the motor within the housing. The arrangement is also adapted to accommodate protecting the motor and capacitor leads of an external capacitor type motor.

4 Claims, 3 Drawing Figures

PRIOR ART

FORCED AIR FURNACE MOTOR LEAD WIRE PROTECTION

BACKGROUND OF THE INVENTION

1. Field of the Invention:

The invention pertains to forced air furnaces with direct drive blower motors and in particular to motor electrical lead protection means in such an environment.

2. Description of the Prior Art:

We are unaware of any patents or publications which are considered relevant to our claimed invention. However, it is believed that the invention and its scope may be better understood in connection with a conventional furnace arrangement and at least one alternate way used commercially for solving the problem which our invention solves.

In most jurisdictions it is considered safe and acceptable practice in connection with appliances in general and with forced air furnaces in particular to provide an arrangement in which non-metallic flexible electric motor leads from a blower motor extend through spaces within the furnace cabinet to which the user has access to a junction box where connection to other furnace elements is made internally. However, in at least one jurisdiction, and perhaps others, more stringent requirements with respect to electrical wiring have been embodied in electrical codes to decrease any chance of wiring within the cabinet and accessible to the user from being damaged during any kind of service operation. While the benefit-to-cost ratio of arrangements which comply with stringent code requirements can be questioned, the manufacturer is faced with the dilemma of standardizing upon an arrangement which complies with the most stringent code, or providing an arrangement in which code compliance in selected jurisdictions can be accomplished without unreasonable modifications and labor.

The specific problem which we believe our invention solves in a novel fashion is providing protection against damage to electric motor lead wires during servicing of the furnace components within the furnace cabinet. The solution permits the manufacture of furnaces in a standard arrangement but with a conversion to a complying arrangement being able to be achieved with relatively simple parts, little labor, and no disturbance to the basic blower housing-motor mounting arrangement.

A somewhat more detailed description of the standard arrangement of applicant's assignee will be set forth in connection with the prior art FIG. 1.

SUMMARY OF THE INVENTION

The arrangement according to our invention is applied to a forced air furnace having a cabinet with a double inlet centrifugal blower housing containing a fan wheel and a direct drive motor which is resiliently supported internally of the housing with the housing being mounted on a slidable support plate, and with the motor having non-metallically shielded electrical leads exiting from one end of the motor and extending to a location in the cabinet on the other side of the support. In its essentials, the invention contemplates the provision of an electrical junction box mounted on the same side of the blower support plate and with a side of the junction box in generally planar alignment with the one inlet side of the blower from which the motor leads exit, a channel-shaped raceway having a length to extend from the junction box to the location on the motor end where the leads exit, means for holding the electrical leads within the channel of the raceway after the leads are threaded along the channel, and means securing one end of the raceway to said one side of the junction box and securing the raceway at an intermediate location along its length to one inlet side of the blower housing. Thus, the end of the raceway extending along the motor end being unconnected to the motor end so that the resilient character of the motor mount relative to the housing is unimpaired by the motor lead shielding raceway.

DRAWING DESCRIPTION

DESCRIPTION OF THE PREFERRED EMBODIMENT

Figure 1:
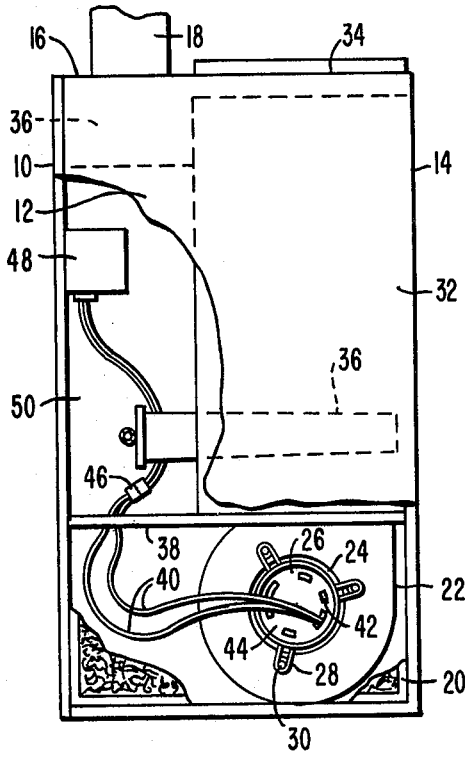
FIG. 1 PRIOR ART
FIG. 1 is a partly broken side view of a prior art furnace to illustrate one basic arrangement to which the invention is applied.

Referring to FIG. 1, the standard arrangement of one forced air furnace, with certain parts considered to be unrelated to the invention omitted, is shown. The cabinet includes a front wall 10, the partly broken away side wall 12, a rear wall 14 and a top wall 16 having an opening through which flue gases exit into the pipe 18. In the particular furnace shown, the lower part of the side wall 12 which as manufactured is provided with a knockout, is shown with the knockout removed to accommodate a return air filter 20. Return air is admitted through the filter to the double inlet centrifugal blower in the lower part of the cabinet, the blower having a scroll-shaped housing 22 with an inlet 24 on each of its opposite sides. A direct drive electric motor 26 is supported internally of the housing in resilient fashion from a three-legged spider arrangement at each of the opposite sides of the blower housing, with each of the spider arrangements 28 being connected to a wire cage encircling the circumference of the motor. The resilient support is accomplished by rubber bushings or grommets 30 at the outer ends of each of the legs of the spider so that the bushing isolates the legs from a direct connection to either the fastener at the outer ends of the legs or the blower housing to which the fasteners are attached. The resilient mounting of the motor and its supported fan wheel (not seen in FIG. 1) is conventional.

The blower draws return air into the scroll through the side inlets and forces it up through a conventional fuel element assembly 32 where it is heated and then discharged out of the heated air outlet 34 in the top wall 16 of the cabinet. A series of gas burner elements 36 extending into the heating element assembly provide the heat for the heat exchanger 32 with the products of combustion passing out through the draft diverter assembly 36 and into the flue pipe 18.

The blower housing is supported underneath a plate or base 38 which extends across the width and for the depth of the cabinet and is of course provided with an opening through which the discharge air from the blower passes. This plate 38 is mounted to be slid forwardly out of the front of the cabinet when the front wall 12 is removed so that convenient access may be had to the blower and motor.

The electrical lead wires 40 from the motor exit out of one of the ventilating holes 42 in the end 44 of the motor. These lead wires 40 are non-metallically shielded ordinary electrical lead wires commonly used for motors and extend up through an opening in the base plate 38 where they are provided with a connector 46 which in turn makes the electrical connection to a junction box 48 in the vestibule space 50 of the cabinet. A number of control elements, such as fan and limit controls are provided in the vestibule space also but are not shown since they are not related to the invention.

As indicated by the prior art legend of FIG. 1, the arrangement so far described is standard and conventional. This arrangement with non-metallically shielded electrical wires passing through various spaces within the cabinet to which access may be had by the user or a serviceman is perfectly acceptable in most jurisdictions. This arrangement is also relatively inexpensive as contrasted to any arrangement in which all of the electrical leads would have to be shielded with metal flex conduit or comparable shielding.

One prior art way in which an arrangement similar to that shown in FIG. 1 has been modified to comply with the electrical code is to simply substitute a metal flexible conduit for the entire length of the leads between the junction box 48, with a receptacle bracket attached to the motor end 44. One significant disadvantage of this arrangement of complying with the code is that it requires that the motor must be removed from the blower housing to permit the installation of the receptacle bracket. Then the motor must be reinstalled within the blower housing and this requires that the motor and fan wheel must be realigned within the housing. Another disadvantage of this prior art arrangement of complying with the code is that various sizes of conduit and conduit fittings must be used because of the various motors used in a variety of direct drive blower assemblies offered to customers. These disadvantages of the prior art arrangements for complying are avoided with our invention which will be described in connection with FIGS. 2 and 3.

Figure 2:
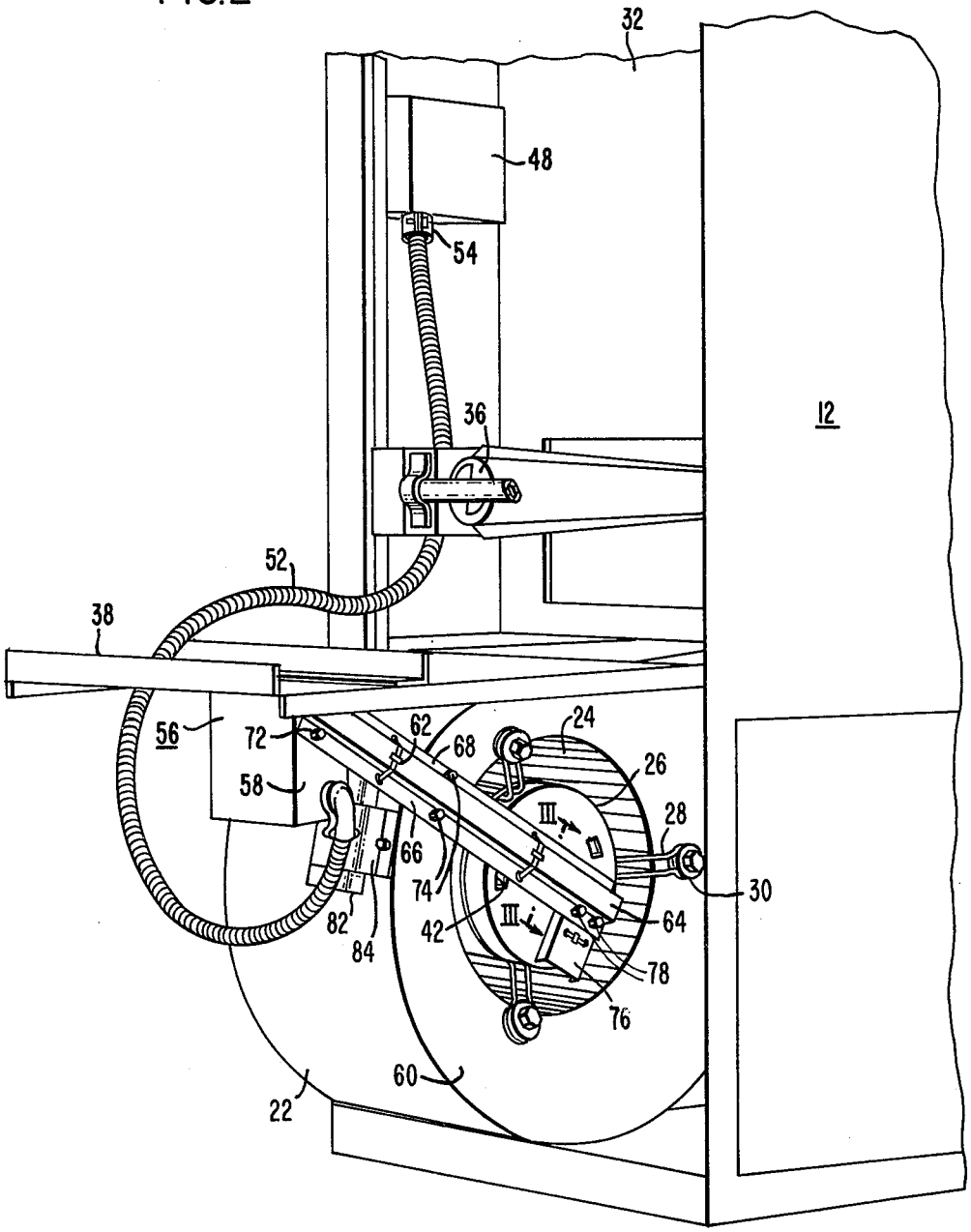
FIG. 2 is a fragmentary perspective view of a forced air furnace with the invention applied to it.

In FIG. 2, the arrangement according to the invention is shown in its completed and final form. This is accomplished in the following way. The blower support plate 38 which is slidably carried along its opposite edges in tracks along the side walls of the cabinet is slid out to its illustrated position to provide the access shown. The length of electrical wire between the connector 46 and the junction box 48 is removed and a length of metal flex conduit encased wire 52 is substituted therefor. A new connector 54 which will accommodate the flex conduit is installed and the connections made within the box 48. It will be noted that the length of the metal flex wire 52 is greater than that for which it was substituted and it is extended down through the same aperture in the support plate 38 so that its end is then below the support plate 38.

The next step is to install the electrical junction box 56 to the bottom face of the support plate 38, this being simply accomplished by drilling two holes in the support plate and attaching the junction box with self-tapping screws. It is important that the junction box 56 be located correctly both with respect to its front to rear location and also its side to side location so that a single conversion kit may be used for any of about five different standard arrangements. The proper location of the junction box with respect to front to rear is necessary to permit the use of pre-drilled holes in some of the parts registering with other parts to which they are to be fastened. The proper location of the junction box with respect to its side to side position is important to get substantially planar alignment between the right side 58 of the junction box and the right side 60 of the blower housing.

The next step in attaining the arrangement according to the invention is to assemble "Panduit" straps 62 to the channel-shaped raceway 64 at the two locations spaced along the length of the raceway as indicated in FIG. 2. These straps are plastic and pass through holes at those locations in the opposite flanges 66 and 68 of the raceway so that the channel is looped transversely. Then the connector plug 46 is cut off or removed from the ends of the electrical leads 40 (FIG. 1) and the wires are first threaded through a central hole in a rubber grommet 70 (FIG. 3) and is then threaded along the channel between the "Panduit" straps and the inside of the raceway channel starting at the motor end of the raceway. The ends of the wires are then passed through a knockout in the right side 58 of the junction box into the junction box. That end of the raceway at the junction box is then aligned to overlie the knockout in the junction box and is fastened to the junction box by a single self-tapping screw 72 passing through the flange 66 and into the right side 58 of the junction box. Then, while holding the raceway in a position which centers its opposite end over the rubber grommet 70, two holes are drilled into the side 60 of the blower housing through predrilled holes in the flanges 66 and 68 of the raceway and two self-tapping sheet metal screws 74 are then used to fasten the raceway to the scroll side 60. Preferably, two small plastic washers which serve as spacers are sandwiched between the flanges 66 and 68 and the blower side scroll. The electrical connection between the metal flex conduit 52 leads and the ends of the original motor wire leads 40 is then made within the junction box 56, the cover replaced and the support plate 38 is then slid back into the cabinet with the blower. It will be noted that the length of the metal flex conduit 52 is sufficiently long that the support plate and blower may be subsequently slid back out of the unit without any requirement of disconnecting electrical leads.

Figure 3:
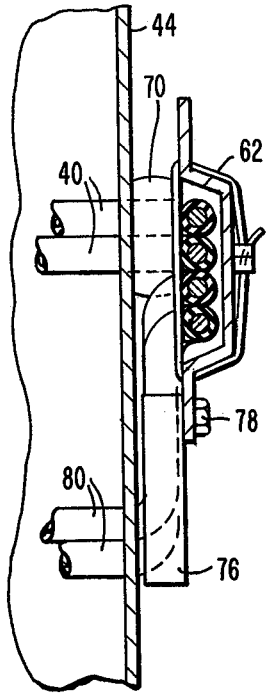
FIG. 3 is a fragmentary sectional view corresponding to one taken along the line III—III of FIG. 2.

As may be seen in FIG. 3, the alignment of the side wall 58 of the junction box in generally planar relation with the side wall 60 of the blower side results in a gap or space between the raceway 64 flanges and the end 44 of the motor, this gap accommodating the rubber grommet 70 and insuring that the resilient support of the motor and blower is not impaired by the arrangement according to the invention.

The preceding description of the invention has been in connection with a motor which is not of the capacitor type. If the motor is of the capacitor type, an additional stub raceway 76 of channel form is used, this being secured by the sheet metal screws 78 through two predrilled holes in the main raceway flange 66. The capacitor leads 80, which exit from a ventilating hole adjacent that ventilating hole from which the motor leads exit the end of the motor, are passed under this stub channel 76 to the main raceway 64 channel and passed along the channel along with the motor leads to a location adjacent the junction box 56. At this location the capacitor 82 has been reinstalled on the blower wrap sheet by a holding strap 84 which has been attached to the blower wrap sheet. As may be seen in FIG. 3, the stub raceway 76 is dimensioned so that it is not in direct contact with the motor end at any point so that the resilient character of the motor mounting is unimpaired.

From the foregoing it will be appreciated that by the use of relatively simple inexpensive parts, and with relatively easily performed labor operations, compliance with the more stringent codes regarding shielding of wires in access spaces is accomplished. This is also accomplished without the considerably more difficult and complex operation of removal of the direct drive motor, its reinstallation and then alignment procedure. Also, the inventive arrangement is not limited in its applicability to one size or type of forced air furnace.

We claim:

1. In a forced air furnace including a cabinet having a double-inlet centrifugal blower housing a fan wheel and a direct drive motor resiliently mounted internally thereof, the blower housing being mounted on one side of a slidable support plate, and the motor having non-metallically shielded electrical leads exiting from one end of the motor and blower housing inlet and extending through the support plate to a location in the cabinet on the other side of the support plate, a conversion arrangement for shielding the leads and connections in the space on the blower side of the support plate, comprising:

an electrical junction box mounted on the same side of said blower support plate as said blower and with a side of said junction box in generally planar alignment with the one inlet side of said blower from which the motor leads exit;

a generally channel-shaped raceway having a length to extend from said junction box to the location on said motor end where said leads exit;

means facing the open side of said channel and connected thereto at selected locations to hold said leads within the channel of the raceway after the leads are threaded along the channel;

means securing one end of said raceway to said side of said junction box;

means securing said raceway at an intermediate location along its length to said one inlet side of said blower housing;

the end of said raceway facing said motor end being spaced away from said motor end and being unconnected thereto so that the resilient character of the mounting of the motor within said housing is unimpaired by said shielding raceway.

2. In an arrangement according to claim 1 including:

an electrically insulating material grommet encompassing said led wires at the location where said leads exit from said motor end, said grommet having a dimension between said motor end and said raceway generally corresponding to the gap between said end and said raceway.

3. In an arrangement according to claim 1 wherein:

said motor is of the type having an external capacitor and leads extending from the end of said motor to said capacitor;

a separate, relatively short channel-shaped raceway extending angularly from said first-named raceway to overlie said capacitor leads in their location extending from a separate exit point of said motor end to the channel of said first-named raceway; and means securing said short raceway solely to said first-named raceway to maintain the resilient character of the mounting of said motor within said housing.

4. An arrangement according to claim 1 wherein:

said retaining means for holding said leads within said channel comprise plastic strap means looping the channel of said first-named raceway at selected locations along its length.

* * * * *